United States Patent [19]

Laviano

[11] 4,225,071

[45] Sep. 30, 1980

[54] TAPE-SEVERING DEVICE

[76] Inventor: Don Laviano, 2 W. 46th St., New York, N.Y. 10036

[21] Appl. No.: 968,617

[22] Filed: Dec. 11, 1978

[51] Int. Cl.[3] ..... B26F 3/02

[52] U.S. Cl. ..... 225/65; 225/66; 255/67

[58] Field of Search ..... 225/65, 66, 61, 67

[56] References Cited

U.S. PATENT DOCUMENTS

| | | | |
|---|---|---|---|
| 2,788,181 | 4/1957 | Anderson | 225/65 |
| 3,069,105 | 12/1962 | Press et al. | 225/66 |
| 3,109,570 | 11/1963 | Maddalena | 225/66 |
| 3,484,030 | 12/1969 | Mattheis | 225/65 |
| 3,968,915 | 7/1976 | Schleicher | 225/65 |

*Primary Examiner*—Harold D. Whitehead
*Assistant Examiner*—K. Bradford Adolphson
*Attorney, Agent, or Firm*—Bauer & Amer

[57] ABSTRACT

A device for severing selected lengths of so-called masking tape from a supply roll, which device is of the type that, for convenience in use, is attached directly to the roll, and in connection with which there has been obviated any springs or the like that adversely affects the tracking of the device about the roll. Instead, the cutting implement of the within device is pivotally traversable and thus effectively takes up the diminishment in the height of the type by partaking of this degree of movement.

2 Claims, 7 Drawing Figures

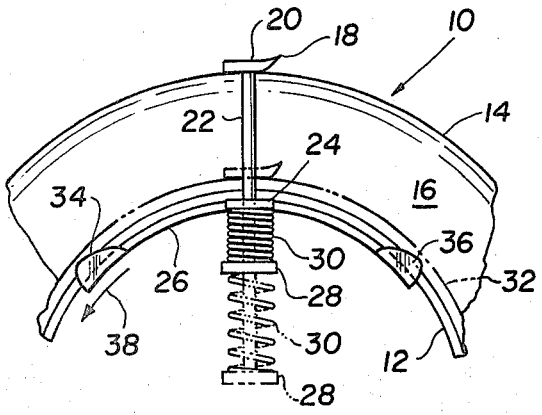
FIG.1
PRIOR ART
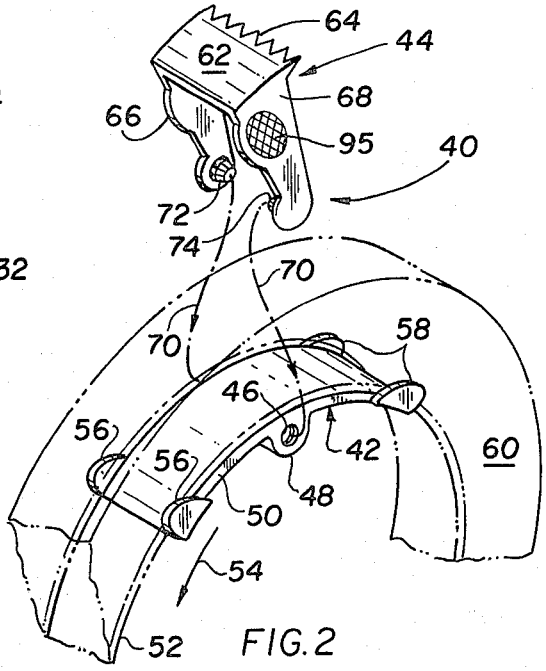
FIG.2
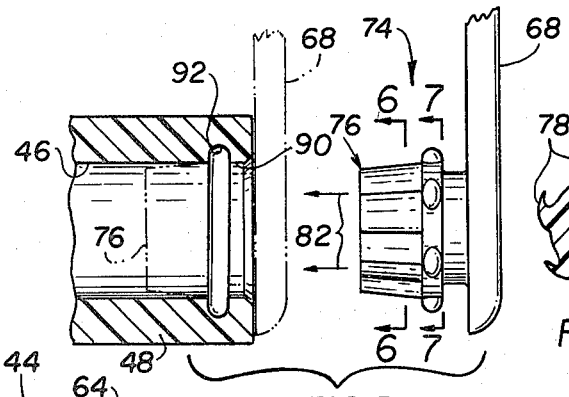
FIG.6 FIG.7
FIG.5
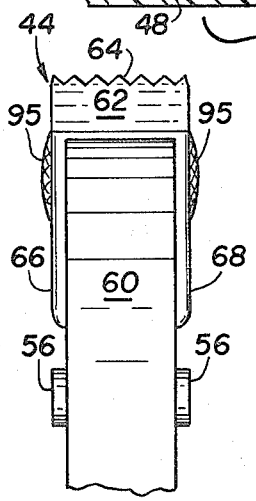
FIG.4
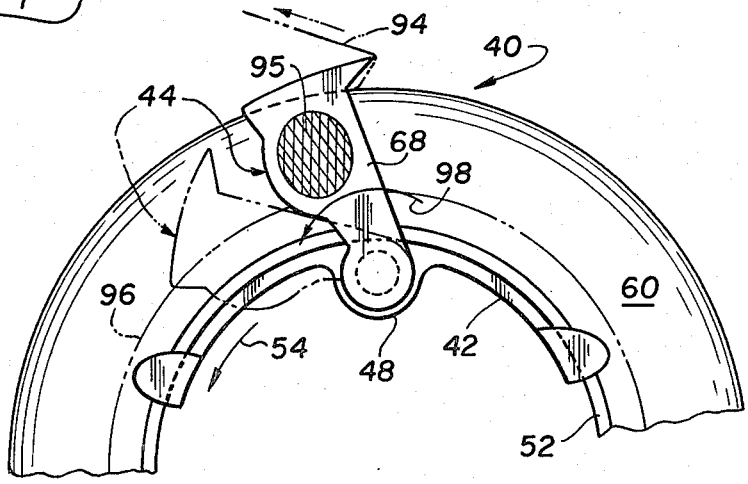
FIG.3

TAPE-SEVERING DEVICE

FIELD OF INVENTION

The present invention relates to an improved tape-severing device or dispenser, the improvements more particularly contributing to an inexpensive, easy-to-attach cutting edge for a so-called masking tape roll, or similar supply source of tape.

DESCRIPTION OF THE PRIOR ART

Numerous models are already well known of devices presenting serrated teeth or the like that are directly attached to masking tape put up in a supply roll to facilitate removal of selected lengths thereof, the referred to prior art devices being exemplified by those covered by U.S. Pat. Nos. 3,556,367 and 3,138,310 and by other patents as mentioned subsequently herein. These patented devices are characterized by a spring, or its equivalent, which performs the necessary function of positioning the cutting edge adjacent the tape and, in the process, thus taking up the diminishment in size which occurs in the height of the tape as it is unwound from the roll and nears depletion. The spring pressure or urgency of these prior art dispensers, however, to be adequate when the roll is practically depleted must initially be of such an extent that unavoidably it produces a depression in the tape, or it adversely interferes with tracking movement about the roll of tape, or is otherwise disadvantageous.

SUMMARY OF THE INVENTION

Broadly, it is an object of the present invention to provide an improved roll-attached dispenser or tape-severing device overcoming the foregoing and other shortcomings of the prior art. Specifically, an object of the within device is to achieve the same desirable performance in the serrated edge wherein it assumes a cutting position adjacent the tape, but without using any spring bias or urgency as might impede tracking movement thereof or otherwise detract from the effectiveness of the device.

An improved tape-severing device demonstrating objects and advantages of the present invention is, as already noted, of the type operatively mounted for sliding movement about a core supporting a supply length of masking, or similar type tape, put up in a roll. The within tape-severing device includes an arcuate shaped slide member operatively arranged to partake of sliding movement along the underside of the core, and has a pair of mounting openings in opposite sides thereof, which also could be a through bore. Cooperating therewith is a tape-severing body member presenting a tape-severing edge thereon, which body has bifurcated opposite legs extending in depending relation therefrom which each terminate in a mounting projection that is in inwardly facing relation to the other. Preparatory to use, the tape-severing body member is thus adapted to assume an operative position disposed in straddling relation over the roll of tape with each said mounting projection thereof projected within a cooperating mounting opening so as to allow for rotative movement therebetween. This rotative movement in turn contributes to corresponding pivotal traversing movement in the tape-severing body member relative to the roll of tape. Completing the construction of the within device is movement-binding means at the interface of each said mounting projection and its cooperating opening which is effective to allow pivotal traversing movement in said tape-severing body member in only one selected direction. As a result, as the supply of tape is payed out from the roll thereby progressively diminishing the height thereof, the tape-severing body member is nevertheless adapted to assume an operative position adjacent the external surface of the roll of tape due to a pivotal traversing movement therein. Moreover, said body member is effectively held in its operative position adjacent the tape by the movement-binding means thereby facilitating its subsequent use.

BRIEF DESCRIPTION OF THE DRAWINGS

The above brief description, as well as further objects, features and advantages of the present invention, will be more fully appreciated by reference to the following detailed description of a presently preferred, but nonetheless illustrative embodiment in accordance with the present invention, when taken in conjunction with the accompanying drawings, wherein:

FIG. 1 is a side elevational view of a prior art embodiment of a tape-severing or dispensing device in connection with which the within device is intended as, and functions as, a significant improvement;

FIGS. 2–7 illustrate the within improved tape-severing device in which, more particularly, FIG. 2 is an exploded perspective view of the two components of the device illustrating the preferred manner in which they are assembled to each other;

FIG. 3 is a side elevational view showing further structural details of the device, and in which exemplary rotative positions of the cutter or tape-severing component are illustrated in full line and phantom perspective;

FIG. 4 is an end elevational view projected from FIG. 3;

FIG. 5 is a partial end elevational view, on an enlarged scale, illustrating in greater detail how the two components of FIG. 2 are assembled, and how the rotative positions of FIG. 3 are achieved; and FIGS. 6 and 7 are sectional views respectively taken on lines 6—6 and 7—7 of FIG. 5, showing further structural details.

DETAILED DESCRIPTION

FIG. 1 illustrates a typical prior art tape dispenser, generally designated 10, of a well known type which is operatively mounted for sliding movement about a cardboard core 12 that supports a supply length of tape 14, commonly called masking tape, that is put up in a roll 16. As is well understood, length portions of the tape 14 are unwound from the roll 16 or, stated another way, tape 14 is payed out from the roll 16 in discrete length portions as needed. As these length portions are unwound, they are cut or severed along a serrated or similarly equipped cutting edge 18 which is presented in the strategic location indicated on a cutter body member 20 having bifurcated legs 22 (only one of which is shown in FIG. 1). As illustrated, the operative position of body member 20 is one in which it is disposed in straddling relation over the roll 16 with each leg 22 extended through a laterally projecting ear 24 of a slide 26 and appropriately engaged, threadably or otherwise, to a retaining member 28. Further, between each ear 24 and member 28 is a compression spring 30 which exerts a bias holding the cutter body 20 against the external surface of the tape roll 16. As the roll of tape is depleted, a condition illustrated by comparing the full line to the phantom line reference 32 thereof, spring 30 of course expands, again as illustrated in phantom perspective in FIG. 1, and thus correspondingly maintains the cutter head 20 against the external surface of the tape roll 16.

The slide 26 on which the well known cutter body 20, as just generally described, is connected is also well known. More particularly, slide 26 is constructed preferably of plastic and has an arcuate shape as illustrated and, in addition to the centrally located laterally extending ears 24, also includes a pair of vertically oriented ears at opposite ends, designated 34 and 36 respectively, which assist in proper tracking of the slide 26, as in the direction 38, along the underside of the cardboard core 12. The referred to tracking movement 38 of course makes it possible to release or unwind the selected length of the tape 14 from the supply roll 16.

Thus far what has been described is, as already indicated, well understood and is embodied in many different models of prior art tape dispensers of which, to name just a few, are the patented tape dispensers of U.S. Pat. Nos. 3,556,367, 3,138,310, 3,140,805, 2,731,084, 2,447,518, 2,401,286, and 2,284,807. While the aforesaid prior art dispensers provide the convenience of having a physically attached, and therefore readily available, cutting edge 18 to facilitate the severing removal of a selected length of tape from the remaining supply 16 thereof, the characterizing use by this prior art of a spring, such as spring 30, to maintain the cutter 20 adjacent the external surface of the roll 16 introduces significant shortcomings. As might be readily surmised, spring 30 has to function when roll 16 is full and when it is almost depleted, such as depicted by reference numeral 32, and thus has difficulty performing under these two diverse conditions. To have enough urgency when the roll is depleted, spring 30 must of necessity have an urgency of such an extent in the beginning that when it presses against the full tape roll it causes an undesirable depression therein, and also interferes with sliding movement 38 of the prior art dispenser about the tape roll 16.

The within improved tape dispenser overcomes the foregoing and other shortcomings of the prior art. Specifically, said improved tape-severing device, illustrated more particularly in FIGS. 2–7, takes up the difference in height of the tape roll from its initial full to its depleted condition, not by using compression spring 30, but by introducing a pivotal traverse in the cutter body. In other words, and as will be explained in detail subsequently, the body of the tape-severing device is operatively arranged to partake of a pivotal traverse which carries it into adjacent position against the external surface of the tape supply roll, and thus in position to enable the supply length of tape to be severed from the roll. However, since the pivotal traversing movement as just referred to does not require any spring urgency to bring it about, the undesirable indentation into the roll is obviated as is also any undue friction which interferes with sliding movement of the device about the inner surface of the core.

As is perhaps best illustrated in FIG. 2, the improved device hereof, generally designated 40, essentially consists of two components, a slide 42 and a body member 44. The construction material of slide 42 is preferably of soft plastic, such as vinyl, so that this soft plastic is available as a wall bounding a central opening 46 of a centrally located projection 48, to which body 44 is operatively arranged for the pivotally traversing movements referred to. Before discussing such movement, however, it is convenient at this point to note that slide 42 has an arcuate shaped body 50 which matches the shape of the cardboard core 52 and which slides along the inner surface, as in the direction 54, of the core. The pair of cooperating ears 56,58 at opposite ends of the slide body 50 are strategically located on opposite sides of the core 52 and of the tape supply roll 60 adjacent thereto, to facilitate proper tracking of the slide 42.

Turning now to the tape-dispensing device body 44, the same is preferably fabricated of a hard plastic, such as acrylic, and includes a transversely oriented upper leg 62 provided with serrations 64 along one edge, and having bifurcated legs 66 and 68 extending in depending relation therefrom. As a result of this three-leg construction, body member 44 is well adapted to be disposed in straddling relation over the tape roll 60, as illustrated by the reference arrows 70, preparatory to completing the assembly thereof to the slide 42.

More particularly, and essential to providing the improvements of the within invention, on the inside of each of the legs 66 and 68 there are identically constructed trunion-like projections 72 and 74 which extend in facing relationship to each other. The specifics of the structural features of these projections 72 and 74 are more particularly illustrated in FIGS. 5, 6 and 7, to which figures reference is now made. Taking projection 74 as illustrative of both, the same is of a slightly conical shape and thus has a progressively diminishing diameter in its forward portion 76 which is physically inserted into the previously noted mounting opening 46. In a preferred embodiment, the mounting openings 46 are provided as a through bore in the central projection 48 of slide 42. As illustrated in the sectional view of FIG. 6, the inserted portion 76 is molded or otherwise appropriately provided with a circumferential arrangement of teeth, individually and collectively designated 78 which, in the present instance, function as a pawl in the mechanical sense that such teeth 78 allow only rotational movement in a counter-clockwise direction 80, as illustrated in FIG. 6. That is, it will be understood that the teeth 78 are adapted to compress slightly when the projection 74 is urged through mounting movement 82 into its cooperating opening 46, said flexing being attributable to a great extent to an undercut 84 included in the construction of each tooth 78. This extent of flexibility of course permits rotational movement 80, but in the opposite direction of rotation, namely clockwise, the tips 86 of each of the teeth are urged into engaging or binding contact against the cylindrical surface bounding the opening 46 and thus prevent rotation in a clockwise direction. Since, as mentioned earlier in the description, the construction material of member 48 is a soft vinyl plastic, the harder arcrylic plastic teeth 73, and more particularly the tips 86 thereof, have no difficulty digging into said surface 46, thereby preventing said clockwise rotation while allowing counter-clockwise rotation 80.

To hold each of the projections 72, 74 in place within the openings 76, each has an arrangement of radially extending spherical projections, individually and collectively designated 88, shown in enlarged or exaggerated scale in FIGS. 5 and 7 which, in practice, effectively force through the plastic edge 90 bounding each opposite end opening of the through bore 46 until the spheres 88 reach the location of a cooperating annular groove 92 of the projection or housing 48. Upon reaching the depth of each groove, the spheres 88 have sufficient clearance therein for unimpeded rotational movement about the rotation axis of the through bore 46 while obviating inadvertent dislodgement of the projections 72 and 74 from their operative positions within opposite ends of the through bore 46.

As is perhaps best illustrated in FIG. 3, it is contemplated that initially the within improved device 40 will occupy a position straddling a full roll of tape 60 and that a selected supply length 94 thereof will be unwound therefrom thereby urging the slide 40 into sliding movement 54 along the underside of the cardboard core 52 of the tape supply roll 60. To facilitate holding the tape-severing component 44 in place so that the edge of tape 94 can be cut at the location of the serrated teeth 64, each of the legs 66 and 68 is provided with an external finger grip 95 which the user squeezes to press the legs 66 and 68 against the roll 60 and thus hold the body member 44 against movement relative to the roll 60. Eventually, as tape lengths 94 are payed out from the roll 60, it will significantly diminish the height thereof until the roll is practically depleted and the external surface assumes the location illustrated by the reference line 96. At this time it is necessary also that the body member 44 also assume a position adjacent to the external tape surface, and such position is of course achieved by the body member 44 undergoing a counterclockwise pivotal traverse and thereby assuming the rotational position illustrated in phantom perspective in FIG. 3. Naturally, the pivotal traverse 98 in body member 44 is the result of the rotational or pivotal traversing movement 80 that is the degree of movement permitted by the teeth 78. Thus the pivotal traversing movement 80 in the body member 44 effectively takes up the diminishment in size that occurs in the tape supply roll 60 from when it is initially full until it is completely unwound down to the cardboard core 52. In providing the advantages of a conveniently available roll-attached tape-severing or cutting edge, the within device obviates the prior art disadvantages cited in connection with the exemplary FIG. 1 prior art device, and provides other noteworthy advantages thereover, such as reduced cost, ease of assembly and the like.

A latitude of modification, change and substitution is intended in the foregoing disclosure, and in some instances some features of the invention will be employed without a corresponding use of other features. Accordingly, it is appropriate that the appended claims be construed broadly and in a manner consistent with the spirit and scope of the invention herein.

What is claimed is:

1. An improved tape-severing device of the type operatively mounted for sliding movement about a core supporting a supply length of tape put up in a roll, said tape-severing device comprising an arcuate shaped slide member operatively arranged to partake of said sliding movement along said core and having mounting openings in opposite sides thereof, a tape-severing body member presenting a tape-severing edge thereon and having bifurcated opposite legs extending in depending relation therefrom terminating in mounting projections facing each other, said tape-severing body member having an operative position disposed in straddling relation over said roll of tape with each said mounting projection thereof projected within and cooperating with one of said mounting openings so as to allow for rotative movement therebetween contributing to corresponding pivotal movement in said tape-severing body member relative to said roll of tape, and movement-binding means consisting of circumferentially spaced radially extending teeth on each said mounting projection and a surface bounding each said cooperating mounting opening of a selected construction material that binds upon physical contact with said teeth so as to allow pivotal movement in said tape-severing body member in only one selected direction, whereby as said supply of tape is payed out from said roll progressively diminishing the height thereof said tape-severing body member is nevertheless adapted to assume an operative position adjacent said roll of tape due to a pivotal movement therein and is effectively held in said operative position by said movement-binding means.

2. The improved tape-severing device as defined in claim 1 wherein said teeth have surface-engaging tips thereon tangentially oriented so as to contribute to said binding with said mounting opening surface in only one rotational direction.

* * * * *